United States Patent [19]

Patrick

[11] 4,371,993

[45] Feb. 8, 1983

[54] BIDET ALTERNATIVE APPARATUS

[76] Inventor: Billy J. Patrick, Rte. 2, Sulphur, Okla. 73086

[21] Appl. No.: 229,763

[22] Filed: Jan. 29, 1981

[51] Int. Cl.[3] ..... A47K 3/22

[52] U.S. Cl. ..... 4/448; 4/363; 128/239

[58] Field of Search ..... 4/363, 420.4, 420.5, 4/443, 444, 447, 448, 420.1, 420.2; 128/239, 240

[56] References Cited

U.S. PATENT DOCUMENTS

| | | | |
|---|---|---|---|
| 1,752,782 | 4/1930 | Burton | 4/448 |
| 2,027,588 | 1/1936 | Hannon | 4/420.1 X |
| 2,212,706 | 8/1940 | Cohn et al. | 128/239 |
| 2,241,823 | 5/1941 | McFarland et al. | 4/448 X |
| 2,826,761 | 3/1958 | Lazarus et al. | 4/448 X |
| 3,090,965 | 5/1963 | Panza | 4/420.1 X |
| 3,486,503 | 12/1969 | Porter et al. | 128/239 |
| 3,810,260 | 5/1974 | Lodi | 4/420.4 |
| 4,178,931 | 12/1979 | Lind et al. | 128/251 X |

*Primary Examiner*—Charles E. Phillips
*Attorney, Agent, or Firm*—Giles P. Lay

[57] ABSTRACT

A bidet alternative apparatus, receivable atop the water tank of a toilet, formed from a housing having three fluid chambers formed therein. The fluid chambers are connected, via a plurality of hollow pipes, to a pump disposed in the housing; a manually operable rotary valve is provided for selection of the fluid chamber with which the pump fluidly communicates. A flexible conduit, storable in the housing, is connected at one end to the output port of the pump, and at its opposite end to a nozzle. An operator handle is fixedly engaged with the nozzle to be directed by the operator for douching purposes. A nozzle protection cap, removably installable on the nozzle, and a flow control valve, disposed in the flexible conduit, are provided.

2 Claims, 6 Drawing Figures

BIDET ALTERNATIVE APPARATUS

BACKGROUND OF THE INVENTION

The present invention relates generally to the field of personal health care, and more particularly, but not by way of limitation, to an improved douche arrangement which serves as a bidet alternative apparatus.

Social mores and customs have long influenced the design of equipment used by women to cleanse their genitals. In some European countries bidets, which by dictionary definition are stool like fixtures with running water that are straddled for washing the genitals, are prominently and permanently installed in bathrooms. In such areas bidets are considered no more offensive to the sight than toilets or urinals. In many areas of the United States, however, bidets have been considered as very offensive to the sight. Thus there are few homes in the United States having bathrooms with either plumbing or floor space provisions adequate for the installation of bidets. In such homes non-plumbed douche equipment is normally used as a bidet substitute.

Non-plumbed douche equipment, operated by trained professionals, can be readily used to deliver medicinal fluids to the internal body cavities of patients with the proper amount of pressure at a controlled rate of flow. Self-administered douching is more erratic and unpredictable. Conventional bidet fixtures perform the cleansing operation more effectively and more safely than douche equipment designed for self administrations because of the positive control for rate of flow and pressure of the cleansing fluid.

SUMMARY OF THE INVENTION

The present invention provides a bidet alternative apparatus which comprises a housing having at least one internal compartment. A douching unit and a pumping unit having fluid communication with the internal compartment are provided so that cleansing fluid placed in the internal compartment is selectively pumped to the douching unit and delivered thereby as a fluid or spray in douching contact with the genital portion of an operator's body.

An object of the present invention is to provide a bidet alternative apparatus which serves as cleansing equipment for genitals wherein selected cleansing fluids can be delivered with a controlled pressure and flow rate through a douching nozzle.

Another object of the present invention, while achieving the above stated objective, is to increase the sanitation of a bidet apparatus by providing a self cleansing douche nozzle for facilitating after use cleansing.

Another object of the present invention, while achieving the above stated objectives, is to provide a bidet alternative apparatus permitting selection of douching liquids used individually or in combination.

Another object of the present invention, while achieving the above stated objectives, is to provide a bidet alternative apparatus having a protective housing which provides ready storage of the apparatus and permits ready removal, usage and concealed restorage.

Another object of the present invention, while achieving the above stated objectives, is to provide a bidet alternative apparatus that reduces the probability of used and contaminated cleansing fluid from contacting external body surfaces during operation thereof.

Other objects, advantages and features of the present invention will become apparent when the following detailed description is read in conjunction with the accompanying drawings and the appended claims.

DESCRIPTION OF THE PREFERRED EMBODIMENT

Figure 1:
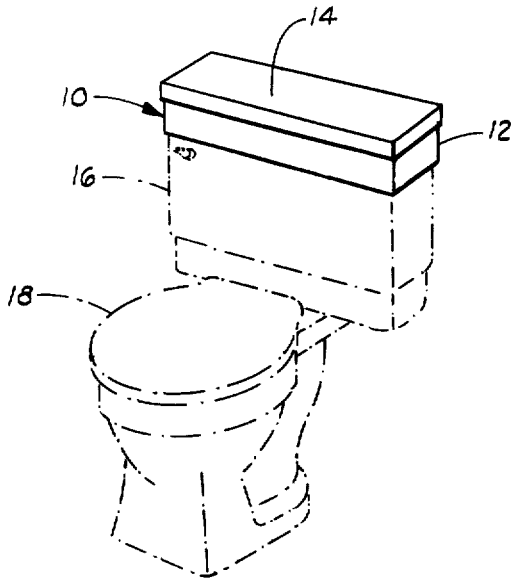
FIG. 1 is an isometric view of a bidet alternative apparatus constructed in accordance with the present invention and disposed in its preferred position of storage atop the reservoir of a water closet.

Referring to the drawings in general and to FIG. 1 in particular, shown therein is a bidet alternative apparatus 10 constructed in accordance with the present invention and which comprises a housing 12 and a housing lid 14. The bidet alternative apparatus 10 is designed to have a configuration permitting it to be positioned atop the reservoir or water tank 16 of a conventional toilet or water closet 18 which is depicted in broken-line view in FIG. 1.

Figure 3:
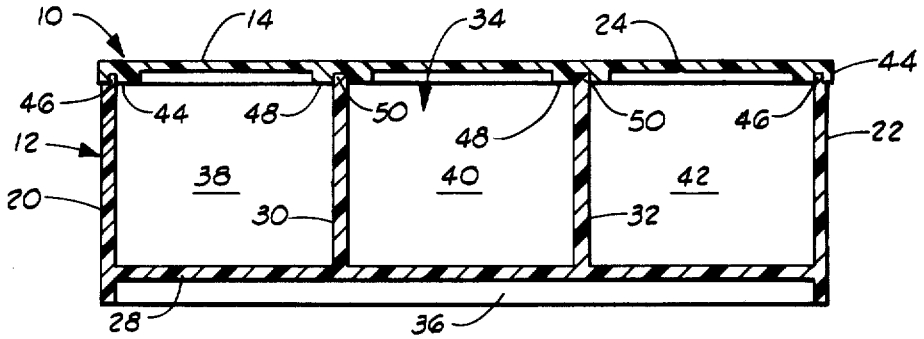
FIG. 3 is a cutaway view taken along 3—3 in FIG. 2.
Figure 2:
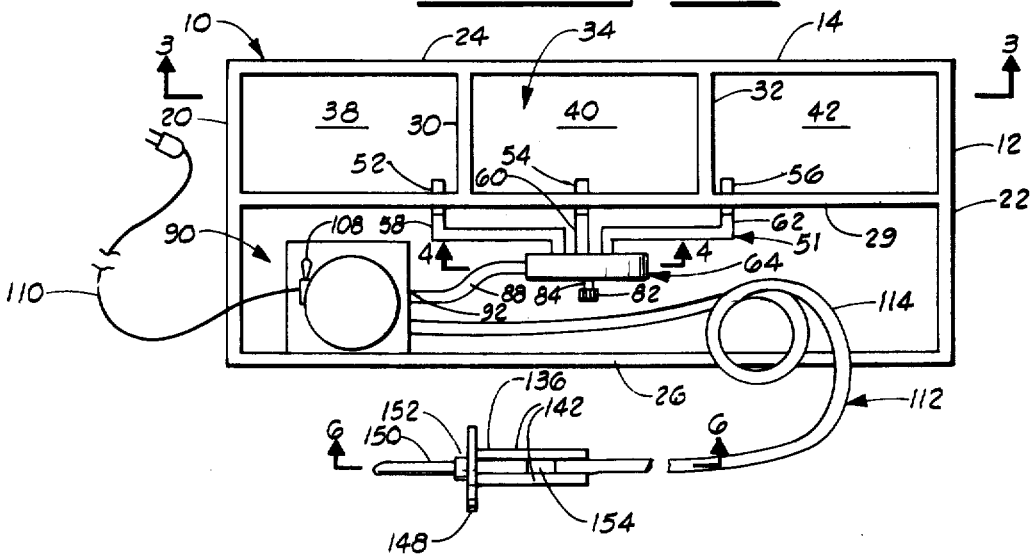
FIG. 2 is a top plan view of the bidet alternative apparatus of FIG. 1 with the housing lid removed and the douching portion of the bidet alternative apparatus withdrawn from its storage position.

FIG. 2 shows the bidet alternative apparatus 10 in top plan view with the housing lid 14 removed so as to show the inner components thereof, and FIG. 3 shows an elevational view taken at 3—3 in FIG. 2 with the exception that the housing lid 14 is shown disposed on the housing 12 in FIG. 3. The housing 12 has an end wall 20, an end wall 22, a back wall 24, a front wall 26, a bottom portion 28, and an internal wall 29 extending upwardly from the bottom portion 28 and between the end walls 20, 22 as shown. A pair of internal walls 30 and 32 extend upwardly from the bottom portion 28 between the back wall 24 and the internal wall 29 to form a multiple internal compartment arrangement 34. The housing 12 also has a lower extensive rim 36 that is configured to fit over the reservoir 16 of the water closet 18 when the housing 12 is disposed thereupon.

The internal compartment arrangement 34 comprises a first fluid chamber 38, a second fluid chamber 40 and a third fluid chamber 42. These fluid chambers are isolated from each other, and these chambers are sealed from the external environment by the housing lid 14 which has an external rim portion 44 that sealingly engages an upper rim surface 46 at the upper portion of the housing 12. The housing lid 14 is equipped with compartment upper rims 48 that sealingly engage with compartment upper rim surfaces 50 of the internal walls 30 and 32 to form fluid seals in order to protect douching fluid from spills, contamination and evaporation during storage.

As will be clear from the cutaway view of FIG. 2, the removal of the housing lid 14 provides access to the internal compartment arrangement 34. The first fluid chamber 38, the second fluid chamber 40 and the third fluid chamber 42 are in fluid communication with a fluid routing assembly 51. Comprising the fluid routing assembly 51 are hollow nipples 52, 54 and 56 which extend through the internal wall 29 and penetrate, respectively, the first, second and third fluid chambers 38, 40 and 42. Further comprising the fluid routing assembly 51 are hollow rigid pipes 58, 60 and 62, each of which connect at one of their ends, respectively, to the nipples 52, 54 and 56. At their opposite ends, the pipes 58, 60 and 62 connect to the inlet ports of a valve 64. The valve 64 is preferably supported in a stationary position by the pipes 58, 60 and 62, or an appropriate support bracket may be provided.

Figure 4:
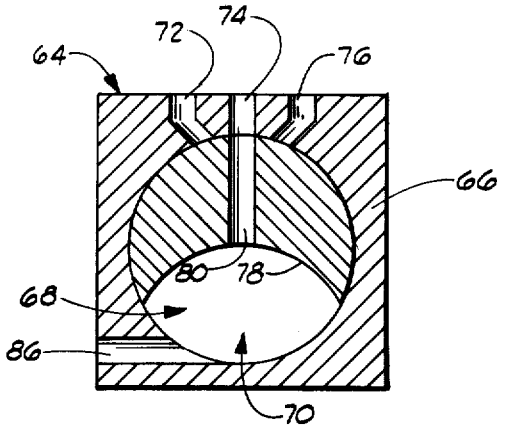
FIG. 4 is a cutaway view of the rotary valve along 4—4 in FIG. 2.

The valve 64, shown in cutaway view in FIG. 4, has a valve body 66 which has a cylindrical-shaped internal cavity 68 so as to provide a common sump portion 70 in the cavity 68. The valve 64 has inlet ports 72, 74 and 76 which extend through the valve body 66 to communicate with the cavity 68. The valve 64 is provided with an internally disposed core member 78 within the cavity 68, the core member 78 having a single connecting port 80 which selectively communicates between one of the inlet ports 72, 74, 76 and the common sump 70. In FIG. 4 the core member 78 is oriented so as to align the connecting port 80 with the inlet port 74. The valve 64 is provided with a knob member 82 (shown only in FIG. 2) which has a stem 84 that extends through an aperture in the wall of the valve 64 and connects to the core member 78. This permits manual rotation of the core member 78 via the knob 82 in order to position the core member 78 so as to selectively determine the fluid communication between the inlet port 72, 74, and 76 and the common sump 70. The valve 64 also has an outlet port 86 which extends through the valve body 66 to communicate with the common sump 70.

The rigid pipes 58, 60 and 62, shown in FIG. 2, connect respectively to the inlet ports 72, 74 and 76. This arrangement provides for selective fluid communication between the first, second and third fluid chambers 38, 40 and 42 with the common sump 70. Inasmuch as rotary valves like that described as the valve 64 are generally conventional, additional details of construction are not believed necessary herein.

Figure 5:
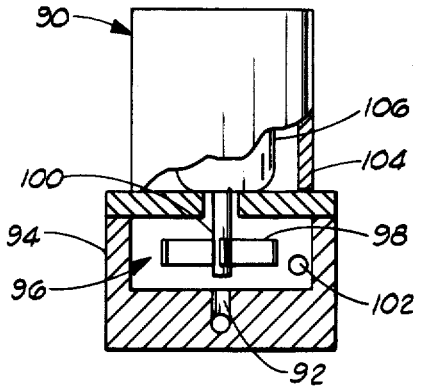
FIG. 5 is a partial cutaway view of the fluid pump shown in FIG. 2.

Returning to FIG. 2, the fluid routing assembly 51 further comprises a valve outlet pipe 88, which is connected to the outlet port 86 of the valve body 66. The valve outlet pipe 88 extends to be connected to a pump 80 having a pump inlet port 92. The pump 90, shown in partial cutaway view in FIG. 5, has a valve body 94 through which the inlet port 92 extends; a central chamber 96; an impeller 98 connected to a rotative drive shaft 100; and an outlet port 102 extensive through the valve body 94 for the ejection of a pump fluid. An electric motor housing 104 seals central chamber 96 and positions an electric motor 106, which is appropriately equipped with a control switch 108 (shown in FIG. 2) and an electric cord 110 (also shown in FIG. 2) that is extensive for connection to a source of electric power. When power is provided to the electric motor 106, the motor drive shaft 100 rotates the centrifugal impeller 98 to produce pumping action. Inasmuch as electric pumps like that described as the pump 90 are generally conventional, additional details of construction are not believed necessary herein. The pump 90 may be supported by the pipe 88, or it may be disposed on the bottom portion 28 of the housing 12.

The apparatus 10 further comprises a portable fluid delivery assembly 112 which is connected in fluid communication with the pump 90 for dispensing pressurized fluid at a selected location, as required during douching. Comprising the portable fluid delivery assembly 112 is a flexible conduit 114 which may consist of a length of tubing and which is connected at its input end to the pump outlet port 102. The flexible conduit 114 may be easily removed from the housing 12, as required during douching, and may be readily rolled up and returned to the housing 12 for storage after use.

Figure 6:
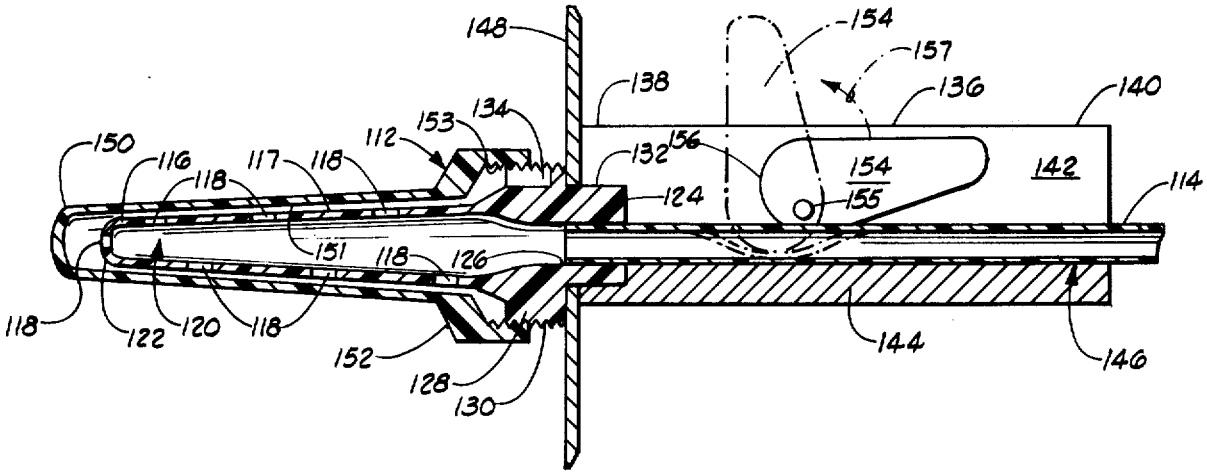
FIG. 6 is a cutaway view of the portable fluid delivery assembly of the bidet alternative apparatus taken along 6—6 in FIG. 2.

As shown in FIG. 6, the portable fluid delivery assembly 112 further comprises a hollow tubular member shaped and sized as a nozzle 116, having a sprayer surface 117 in which a series of spray apertures 118 are formed. The spray apertures 118 communicate with an inner bore 120 extending from the first end 122 to the second end 124, the second end 124 being open and having an internal mating surface 126 configured to connectively engage in a sealable manner with the output end of the flexible conduit 114 in the manner shown. The second end 124 is shaped to have a threaded portion 128 having threads 130 and an extensive handle insert portion 132. The threaded portion 128 of the second end 124 is provided with at least one cleansing aperture or cleansing slot 134 which extends along a portion of the length of the threaded portion 128, the cleansing slot 134 serving a cleansing purpose to be described later.

Further comprising the portable fluid delivery assembly 112 is an elongated operator handle 136 having a first end 138 and a second end 140. The operator handle 136 is characterized by sidewalls 142 (only one of the sidewalls 142 is shown in the cutaway view of FIG. 6) extensive from a base portion 144 forming an internal channel 146 extensive between the first and second ends 138, 140. The first end 138 of the operator handle 136 is shaped to receive the insert portion 132 of the nozzle 116 in a pressing retention fit, and a splash shield 148, having an appropriately sized and shaped aperture formed therein, is provided to be received over the operator handle insert portion 132 so as to be retained against the first end 138 of the operator handle 136 when the insert portion 132 is pressed into the first end 138.

Further comprising the portable fluid delivery assembly 112 is a nozzle protection cap 150, having an enclosing surface 151 and a capping portion 152 with internal threads 153. The enclosing surface 151 serves to cover the nozzle 116 in the manner shown in FIG. 6. That is, the enclosing surface 151 may be removably disposed in overlaying, spaced-apart relation to the sprayer surface 117 of the nozzle 116 by threading the nozzle protection cap 150 via the threads 152 onto the mating nozzle threads 130, which function as a nozzle protection cap-engaging surface.

A flow control assembly, comprising an adjustable cam lever 154, is pivotably mounted between the operator handle sidewalls 142 via the arbor 155 so that the cam surface 156 may establish distortive contact with the flexible conduit 114 (as shown by the broken lines in FIG. 6) for selectively restricting the rate of fluid flow through the conduit 114 when the cam lever 154 is moved in the direction of the arrow 157; as depicted by the broken line view of the cam lever 154 in FIG. 6, the conduit 114 can be completely stopped as the conduit 114 is pinched shut by the cam surface 156. Inasmuch as such flow control assemblies are conventional, additional details of construction are not believed necessary herein.

OPERATION

The preferred method of using the bidet alternative apparatus 10 is to place the housing 12 on the reservoir 16 of a water closet 18 and remove the lid 14. With the lid 14 removed, the first, second and third fluid chambers 38, 40 and 42 are provided with selected fluids as desired for douching.

The positioning knob 82 is manually set for each cycle of douching to deliver cleansing fluid from within the housing 12 to and through the rotary valve body 66 to the pump inlet port 92. The portable fluid delivery assembly 112 is removed from the housing 12 and the nozzle protection cap 150 is removed from the nozzle 116. The cam lever 154 is positioned in the no-flow position, shown in FIG. 6 by broken lines, the electric cord 110 is connected to an electric power source and the control switch 108 is activated to power the centrifugal impeller 98 and establish pumping action.

The operator assumes a position astraddle of the water closet fixture, inserts the nozzle 116 in the operator's genitals and repositions the cam lever 154 to deliver the douching liquid through the spray apertures 118 at a controlled rate. The splash shield 148 protects the operator handle 136 and the operator from contact with the used cleansing fluid and directs such used fluid into the water closet bowl for disposal. Turning off the control switch 108 terminates the douching action.

To cleanse the douching nozzle 116 after use, the nozzle protection cap 150 is attached to the nozzle threaded portion 128 in a first installed position which is the position shown in FIG. 6. The control switch 108 is activated and cleansing fluid is pumped to and through the spray apertures 118 in the previously described manner with such fluid being entrapped within the internal confines of the nozzle protection cap 150 for controlled emanation through the flow channel provided by the limited longitudinal cleansing aperture 134 in the threaded portion 128 of the nozzle 116. Upon completion of cleansing of the nozzle 116, electrical power is deactivated via the control switch 108 and the nozzle protection cap 150 is advanced to a second installed position (not shown) in which the connector 152 is advanced on the slotted male thread portion 128 so as to sealingly cover the limited longitudinal cleansing aperture 134 and enclose all of the douche nozzle 116 by the nozzle protection cap 150. The portable fluid delivery assembly 112 is then replaced within the housing 12 and concealed from sight by replacement of the housing lid 14.

It is clear that the present invention is well adapted to carry out the objects and to attain the ends and advantages mentioned as well as those inherent therein. While a presently preferred embodiment has been described for purposes of this disclosure, numerous changes may be made which will readily suggest themselves to those skilled in the art and which are accomplished within the spirit of the invention disclosed and as defined in the appended claims.

What is claimed is:

1. A hygiene apparatus comprising:

a portable housing, the housing having a first fluid chamber formed therein;

fluid routing means, disposed within the housing, for fluidly communicating with the first fluid chamber;

pump means, supported by the housing and in fluid communication with the fluid routing means, for pressurizing fluid received from the fluid routing means;

portable fluid delivery means, in fluid communication with the pump means, for dispensing pressurized fluid at a selected location, the housing is characterized as having a second fluid chamber formed therein; and wherein the fluid routing means is characterized as fluidly communicating with the second fluid chamber and comprises:

manually controllable valve means, for selecting a selected one of the first and second fluid chambers with which the pump means fluidly communicates, in which the portable fluid delivery means is characterized as comprising:

a flexible conduit having an input end connected to the pump means, and having an output end;

a nozzle connected to the output end of the flexible conduit, the nozzle having a sprayer surface; and an operator handle fixedly engaged with the nozzle, in which the nozzle is characterized as having a nozzle protection cap-engaging surface and as having a cleansing aperture formed in the nozzle protection cap-engaging surface, the apparatus further comprising:

a nozzle protection cap having an enclosing surface selectively disposable in overlying spaced-apart relation to the nozzle sprayer surface in a first installed position and in a second installed position, the nozzle protection cap characterized as permitting fluid existing the nozzle to drain from the nozzle by flowing through the cleansing aperture when the nozzle protection cap is in the first installed position, and as sealing the nozzle to prevent fluid flow through the cleansing aperture when the nozzle protection cap is in the second installed position.

2. The apparatus of claim 1 wherein the fluid routing means is further characterized as comprising manually controllable valve means for regulating the fluid flow rate in the flexible conduit.

* * * * *